United States Patent [19]

Koike et al.

[11] Patent Number: 4,708,707

[45] Date of Patent: Nov. 24, 1987

[54] BLANK FEEDER FOR PACKAGING MACHINE

[75] Inventors: Mitsuhiro Koike; Yoshihiro Saijo; Tadaaki Kume, all of Tokushima, Japan

[73] Assignee: Shikoku Kakooki Co., Ltd., Tokushima, Japan

[21] Appl. No.: 939,831

[22] Filed: Dec. 9, 1986

[30] Foreign Application Priority Data

Aug. 20, 1986 [JP] Japan ..... 61-196002

[51] Int. Cl.[4] ..... B31B 5/06; B31B 3/78

[52] U.S. Cl. ..... 493/313; 493/122; 493/125; 493/164; 271/165; 271/171; 414/128

[58] Field of Search ..... 493/122, 123, 124, 125, 493/126, 127, 133, 307, 313, 316; 271/165, 171; 414/128

[56] References Cited

U.S. PATENT DOCUMENTS

| | | | |
|---|---|---|---|
| 2,887,021 | 5/1959 | Duffy et al. | 493/313 |
| 2,900,880 | 8/1959 | Enoleson et al. | 493/316 |
| 2,956,483 | 10/1960 | Hartbauer | 493/313 |
| 3,298,288 | 1/1967 | Anderson et al. | 493/313 |
| 3,364,826 | 1/1968 | Austin et al. | 493/165 |
| 3,486,423 | 12/1969 | Mistarz | 493/181 |
| 4,273,322 | 6/1981 | Gunther et al. | 271/149 |

*Primary Examiner*—Frederick R. Schmidt
*Assistant Examiner*—William E. Terrell
*Attorney, Agent, or Firm*—Armstrong, Nikaido, Marmelstein & Kubovcik

[57] ABSTRACT

A blank feeder for a packaging machine for use with folded flat blanks unfoldable into tubes of square to rectangular cross section and having different lengths to form containers of different capacities. The feeder includes a magazine for containing a stack of flat container blanks. The magazine comprises an inclined frame defining a downward delivery opening and having opposite side members, an upper member and a lower member, a pair of blank unfolding pawls provided at the bottom surfaces of the upper and lower frame members and partly projecting into the opening, and a pair of movable blank supports reciprocatingly movable between an upper position above the frame and a lower position below the frame through the opening. The upper frame member is movable by a hydraulic cylinder longitudinally of the frame to adjust the distance between the unfolding pawls to the length of the blank. Blanks are supplied by an elevator to the movable blank supports in the upper position and then placed on fixed blank supports at the frame bottom by lowering the movable supports. When the movable supports are raised to the upper position to remove the remaining blanks from the magazine after packaging, the blanks are transferred from the movable supports onto movable guide rods brought to a fallen position from an upright position on the lower frame member.

5 Claims, 5 Drawing Figures

BLANK FEEDER FOR PACKAGING MACHINE

BACKGROUND OF THE INVENTION

The present invention relates to a packaging machine, and more particularly to a blank feeder for a machine for shaping folded flat blanks into tubes of square to rectangular cross section, closing the tubes each at its one end, filling contents into the tubes and closing the filled tubes each at the other end thereof to form complete containers.

The packaging machine has a magazine for containing a stack of many folded flat blanks which are unfoldable into square or rectangular tubes.

Generally in the field of packaging, it is common practice to produce containers of different capacities by altering the height of containers having the same cross sectional area. For this purpose, blanks of different lengths are prepared.

When a packaging operation is to be started, blanks are usually loaded into the magazine manually by the operator, and after completion of the packaging operation, the remaining blanks are unloaded from the magazine similarly by the operator. Further when the kind of blanks is to be changed, the required portion of the magazine is manually so adjusted as to handle the blanks to be used, in addition to the manual unloading and loading procedures. In the field of packaging, mass production systems are presently being replaced by systems for producing small quantities of a wider variety of commodities. The latter systems require frequent change of blanks which is very cumbersome if the foregoing procedures are followed manually.

SUMMARY OF THE INVENTION

The main object of the present invention is to provide a blank feeder which is adapted to execute the above procedures automatically.

The object of the invention can be fulfilled by a blank feeder for a packaging machine, the blank feeder comprising a magazine for containing a multiplicity of flat blanks in a stack, the magazine having at its lower end a frame defining a downward delivery opening, the frame comprising a pair of side frame members arranged in parallel with each other and each inclined downward from its one end toward the other end thereof, a lower frame member interconnecting the lower ends of the side frame members and an upper frame member extending between the side frame members in parallel with the lower frame member at a position close to the upper ends of the side frame members and movable longitudinally of the side frame members, the side frame members being spaced apart from each other by a distance slightly larger than the distance between the opposite side edges of the blank, the side frame members being respectively provided on their bottom surfaces with a pair of fixed blank supports partly projecting into the delivery opening and spaced apart from each other by a distance slightly smaller than the distance between the opposite side edges of the blank, the lower and upper frame members being respectively provided on their bottom surfaces with a pair of blank unfolding pawls partly projecting into the delivery opening, the frame having means for moving the upper frame member for the blanks of different lengths to be accommodated in the magazine so that the end-to-end distance of the blank unfolding pawls will be slightly smaller than the distance between the opposite ends of the blank, each of the side frame members having at least one fixed guide rod extending upright therefrom, the lower frame member having at least one movable guide rod extending upright therefrom, the movable guide rod being fixed at its base end to a first reversibly rotatable pivot extending in parallel with the lower frame member and being downwardly movable to a fallen position in which the forward end of the rod is at a lower level than the base end thereof, a pair of pivotal arms extending below the fixed blank supports from outside the delivery opening into the delivery opening, each of the pivotal arms being provided at its forward end with a movable blank support, the pivotal arms being respectively fixed at their base ends to second reversibly rotatable pivots extending in parallel with the side frame members, the movable blank supports being reciprocatingly movable between an upper position above the frame and a lower position below the frame through the delivery opening and being positionable, when in the upper position, at a higher level than the base end of the movable guide rod in the fallen position, the magazine having an elevator for moving the blanks upward and downward within the magazine and delivering at the lower limit of its downward movement the blanks to the movable blank supports in the upper position.

An embodiment of the present invention will be described below with reference to the accompanying drawings.

DESCRIPTION OF THE PREFERRED EMBODIMENT

Figure 1:
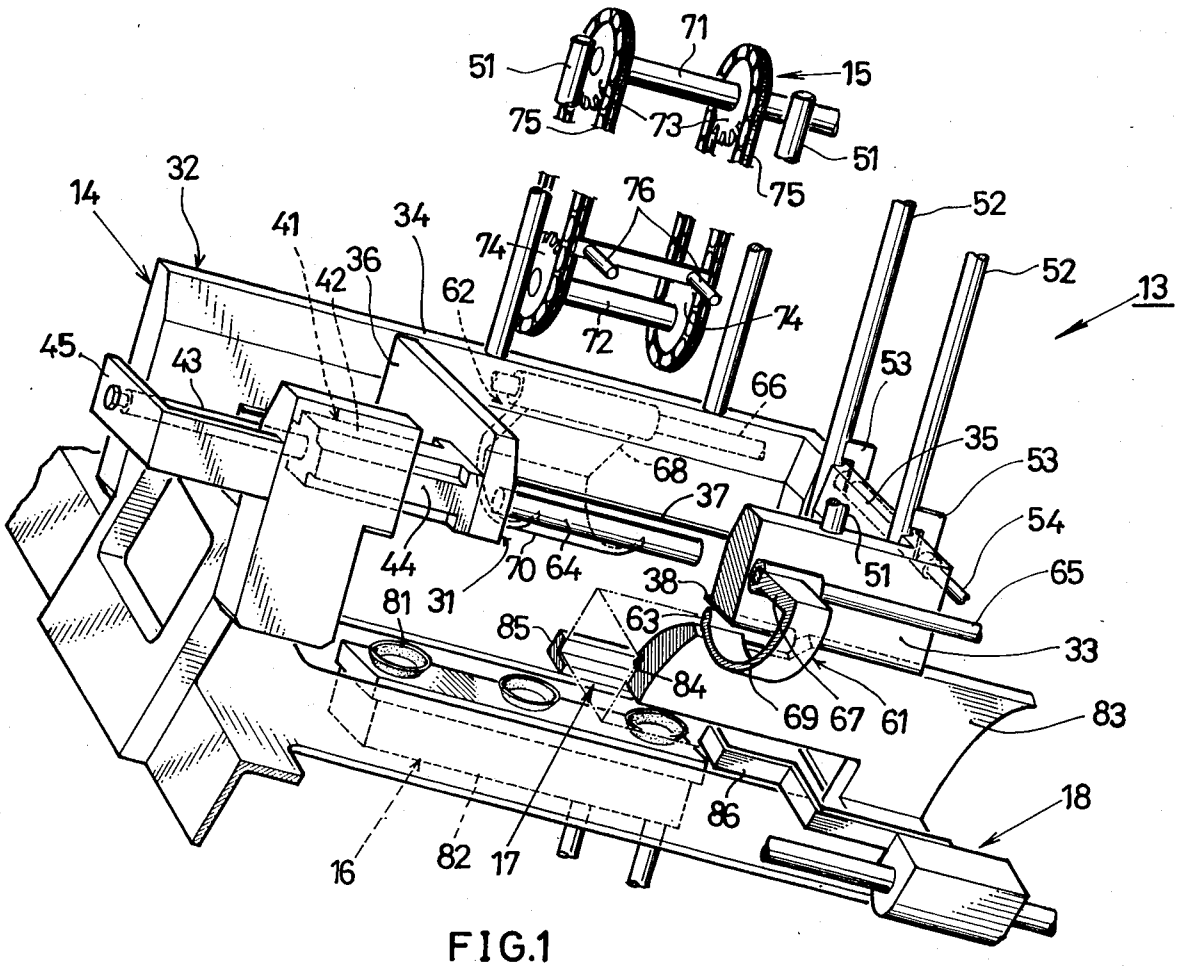
FIG. 1 is a perspective view showing a blank feeder embodying the present invention.
Figure 2:
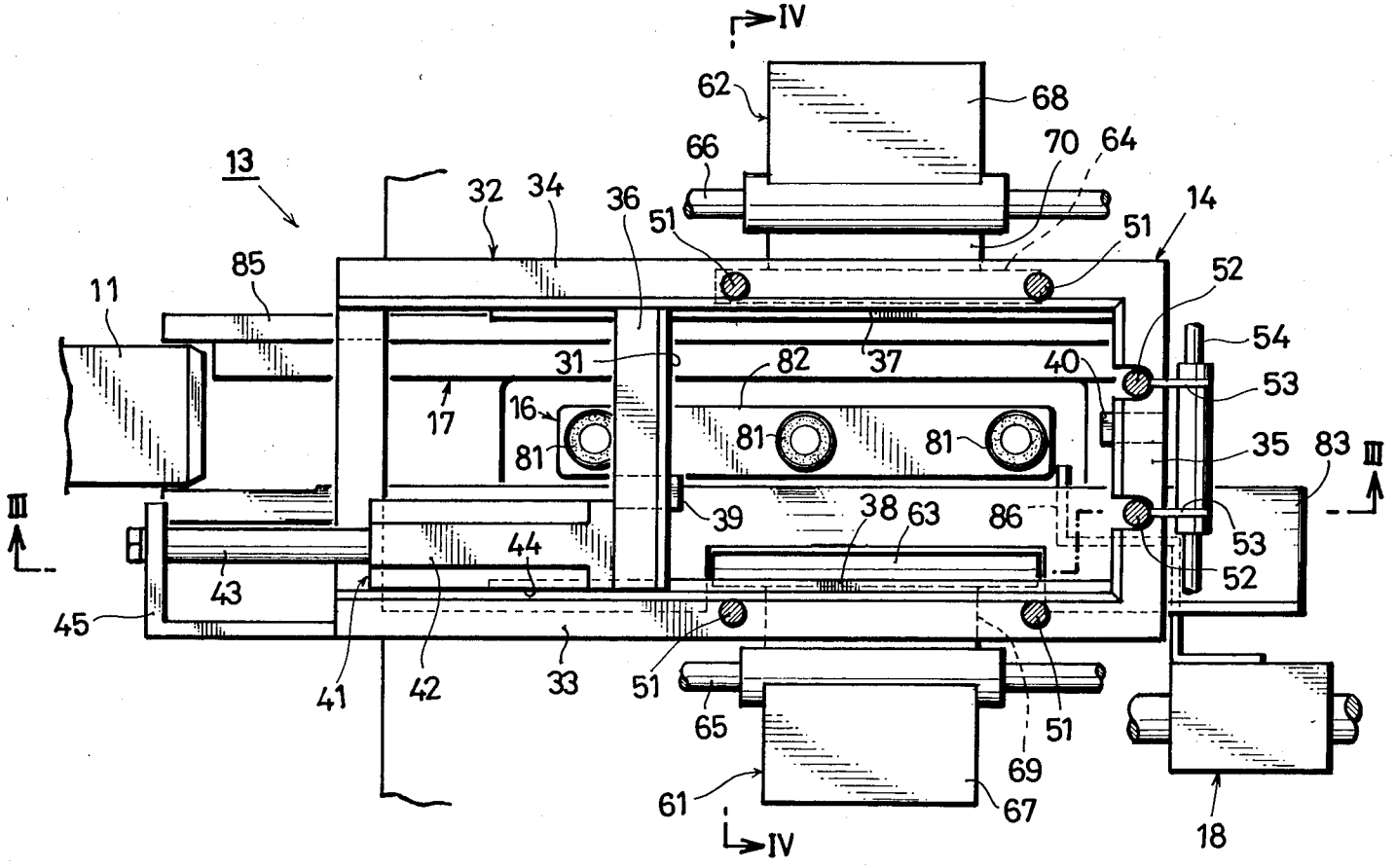
FIG. 2 is a plan view of the feeder.
Figure 3:
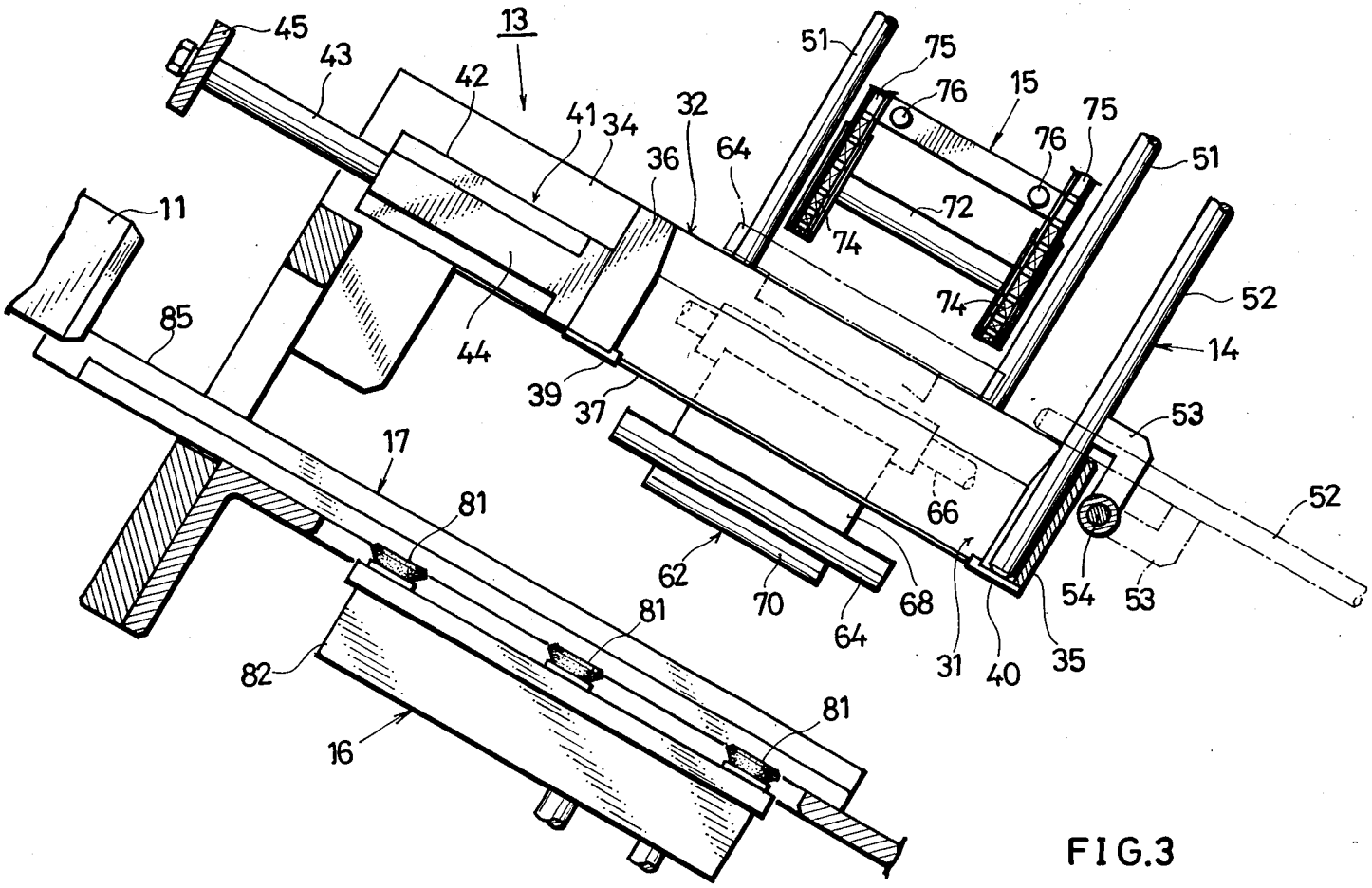
FIG. 3 is a view in section taken along the line III—III in FIG. 2
Figure 4:
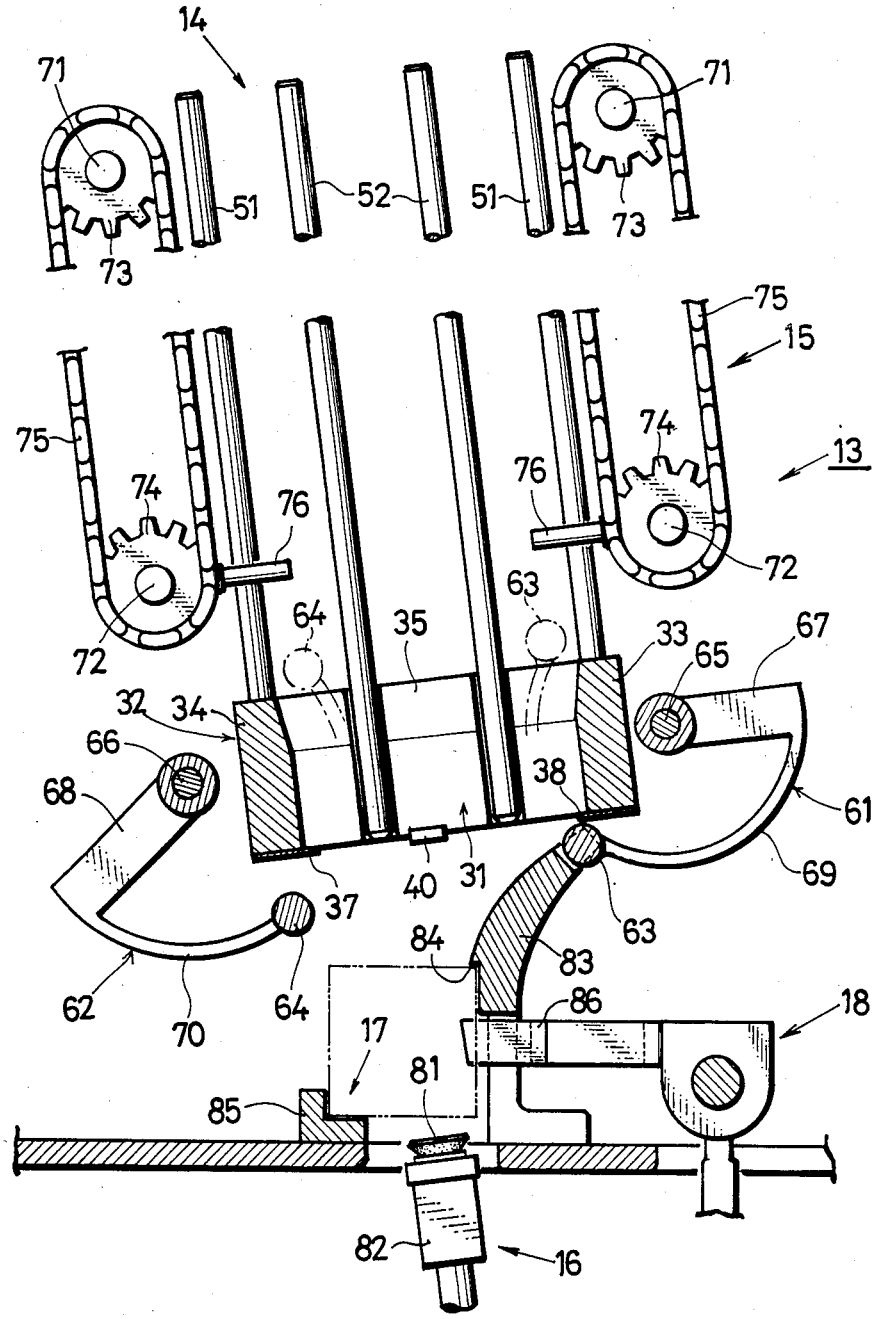
FIG. 4 is a view in section taken along the line IV—IV in FIG. 2.
Figure 5:
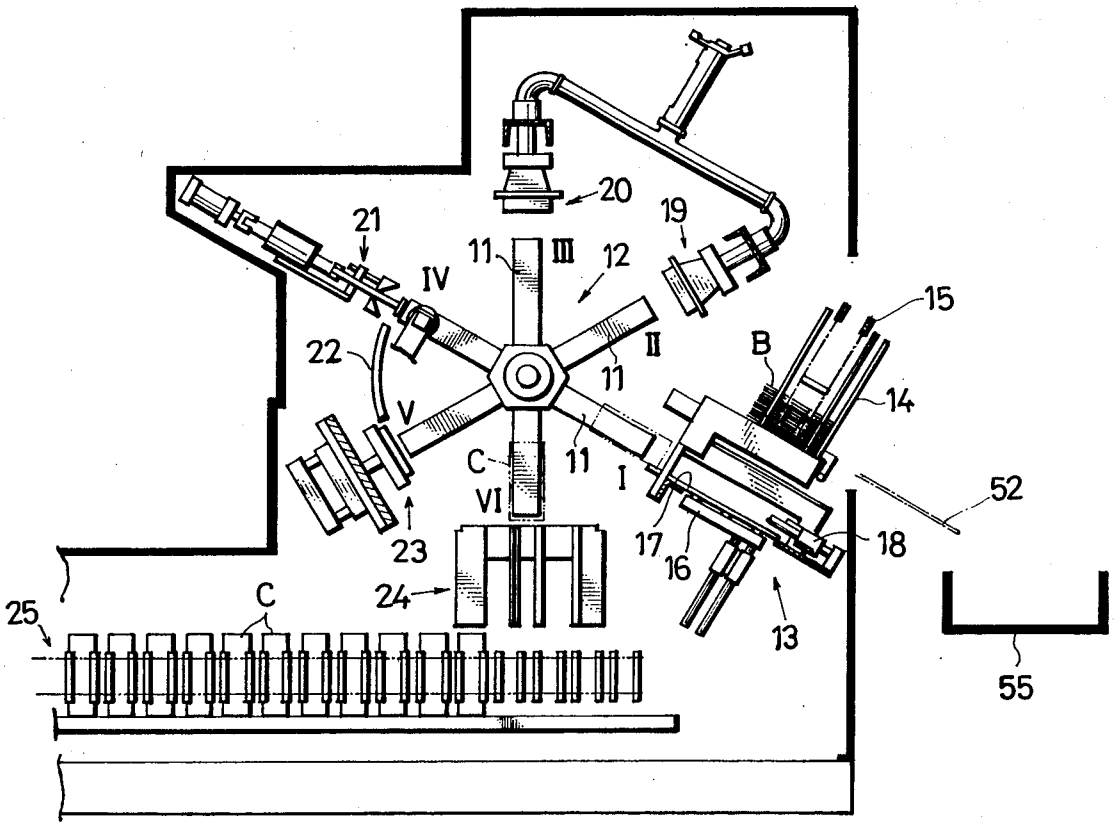
FIG. 5 is a fragmentary side elevation schematically showing a packaging machine including the feeder of the present invention.

With reference to FIG. 5 showing a packaging machine including a blank feeder 13 embodying the present invention, a rotor 12 has six radial mandrels 11. By unillustrated means, the rotor 12 is intermittently driven counterclockwise in FIG. 5. The position where each mandrel 11 stops as rightwardly downwardly inclined at an angle of 30 degrees with a horizontal line in FIG. 5 is a first station I. The mandrel 11 successively stops at six stations including the first station I, i.e. first to sixth stations I to VI. The first station I is provided with the blank feeder 13. The blank feeder 13 has a magazine 14 for accommodating a stack of many folded flat blanks B each unfoldable into a tube of square to rectangular cross section. In addition to the illustrated blanks B, different kinds of blanks (not shown) having different lengths are prepared for the packaging machine. Besides the magazine 14, the blank feeder 13 has an elevator 15 for vertically moving blanks B within the magazine 14, a picker 16 for delivering each flat blank B from the magazine 14 while unfolding the blank into a square to rectangular tube, a holder 17 for retaining the delivered tubular blank B in shape, and a loader 18 for removing the tubular blank B from the holder 17 and fitting the blank onto the mandrel 11 at rest at the first station I. When the blank B is fitted around the mandrel 11, the end of the blank forming the bottom of the container to be obtained is projecting from the mandrel 11. The second and third stations II and III are provided with primary and secondary heaters 19 and 20, respectively, for successively heating the blank end. A breaker 21 for folding the end flat is provided at the following fourth station IV. Disposed between the fourth station IV and the fifth station V is a guide rail 22 for holding the blank end in the folded state. Provided at the fifth station V is a sealing device 23 for pressing and cooling the folded flat end to seal the end and make the blank into a tubular container C having a bottom. At the terminal sixth station VI, a container transfer device 24 is disposed for removing the bottomed tubular container C from the mandrel 11 and delivering the container C onto a container transport conveyor 25. The path of transport by the conveyor 25 has a starting end immediately below the rotor 12 and extends outward therefrom. Although not shown, a group of devices are arranged above the transport path for filling contents into the containers C being transported on the conveyor 25 and thereafter folding the upper end of each container C to the shape of a gabled roof to close the container C.

Of the devices described above, those other than the feeder 13 are well known and will not be described further.

As shown in greater detail in FIGS. 1 to 4, the magazine 14 has at its lower end a frame 32 defining a downward delivery opening 31. The frame 32 comprises a pair of side frame members 33, 34 arranged in parallel with each other and in parallel with and above an extension of the axis of the mandrel 11 at rest at the first station I and each so inclined that one end thereof remote from the mandrel 11 is at a lower level than the other end thereof close to the mandrel, a lower frame member 35 interconnecting and integral with the lower ends of the side frame members 33, 34, and an upper frame member 36 extending between the side frame members 33, 34 in parallel with the lower frame member 35, positioned close to the upper ends of the side frame members 33, 34 and movable longitudinally of the side frame members 33, 34.

One of the side frame members 33, 34 is positioned at a higher level than the other member. The side frame members 33, 34 are spaced apart from each other by a distance slightly larger than the distance between the opposite side edges of the blank B. The side frame members 33, 34 are provided on their bottom surfaces with a pair of fixed blank supports 38, 37, respectively, partly projecting into the delivery opening 31 and spaced apart from each other by a distance slightly smaller than the distance between the opposite side edges of the blank B. Each of the fixed blank supports 37, 38 is a strip extending substantially over the entire length of the side frame member 33 or 34.

The lower and upper frame members 35 and 36 are inclined by an amount corresponding to the difference between the side frame members 33, 34 in level. The lower and upper frame members 35, 36 are respectively provided on their bottom surfaces with a pair of blank unfolding pawls 40, 39 partly projecting into the delivery opening 31. The upper frame member 36 is placed at its opposite ends on the fixed blank supports 37, 38 and is movable by a hydraulic cylinder 41 in this state. The hydraulic cylinder 41 comprises a cylinder tube 42 and a piston rod 43. The cylinder tube 42 externally has four slide guide faces 44 which are T-shaped when seen from the front. The head of the cylinder tube 42 is fixed to the outer side of the upper frame member 36 at a position close to one end of the member 36, with one of the four guide faces 44 in contact with the inside surface of one of the side frame members 33, 34. The piston rod 43 extends longitudinally of the side frame members 33, 34 and is fixed at its forward end to the side frame member 33 by a bracket 45. The hydraulic cylinder 41, when operated, moves the upper frame member 36 with the cylinder tube 42, whereby the position of the upper frame member 36 is adjustable to blanks of different lengths which are to be accommodated in the magazine 14, to make the end-to-end distance between the blank unfolding pawls 39, 40 slightly smaller than the distance between the opposite ends of blanks of a particular length.

Each of the side frame members 33, 34 has two fixed guide rods 51 extending upright therefrom, while the lower frame member 35 has two movable guide rods 52 extending upright therefrom. The movable guide rods 52 are fixed at their base ends to a first reversibly rotatable pivot 54 by inverted L-shaped brackets 53. The pivot 54 extends in parallel with the lower frame member 35. The first reversibly rotatable pivot 54, when rotated by unillustrated suitable means, downwardly moves the guide rods 52 to a fallen position in which the forward ends of the rods 52 are at a lower level than the base ends thereof. Disposed below the forward ends of the movable guide rods 52 in the fallen position is a tray 55 (see FIG. 5) for receiving the blanks remaining in the maganzine 14 and to be unloaded therefrom.

A pair of pivotal arms 61, 62 extend below the fixed blank supports 37, 38 from outside the delivery opening 31 into the opening 31. The pivotal arms 61, 62 are provided at their forward ends with movable blank supports 63, 64, respectively. The pivotal arms 61, 62 have their base ends positioned at the middle of the height of the side frame members 33, 34 and are respectively fixed at these base ends to a pair of second reversibly rotatable pivots 65, 66 extending in parallel with the side frame members 33, 34. Each of the pivotal arms 61, 62 is in the form of a bent strip in its entirety and comprises a straight portion 67 (68) and an arcuate portion 69 (70). The straight portion 67 (68) extends radially of the pivot 65 (66) and has a length equal to the distance between the pivot 65 (66) and the movable blank support 63 (64). The arcuate portion 69 (70) connects the forward end of the straight portion 67 (68) to the movable blank support 63 (64) and coincides with approximately a quarter of a circumference centered about the pivot 65 (66) and having a radius equal to the pivot-to-support distance. The movable blank support 63 (64) is in the form of a round bar extending in parallel with the second pivot 65 (66) and longer than the width of the pivotal arm 61 (62). The second reversibly rotatable pivots 65, 66, when rotated by unillustrated suitable means, reciprocatingly move the movable blank supports 63, 64 between an upper position above the frame 32 and a lower position below the frame 32 through the delivery opening 31. When in the upper position, the supports 63, 64 are positioned at a higher level than the base ends of the movable guide rods 52 in the fallen position.

The elevator 15 comprises upper drive sprockets 73 and lower driven sprockets 74 respectively provided approximately at the same levels as the forward ends and base ends of the fixed guide rods 51 at each side of the magazine 14 and respectively having rotary shafts 71 and 72 extending in parallel with each side frame member 33 (34), an endless chain 75 received around each pair of vertically opposed drive and driven sprockets 73, 74, and a blank support member 76 fixed to the endless chain 75 and projecting outward therefrom. When the blank support members 76 are almost brought into the path of feed travel, close to the fixed guide bars 51, of the chains 75 at each side of the magazine 14 by the drive sprockets 73 rotated by unillustrated suitable means, the forward ends of the blank support members 76 move into the magazine 14 through the space between the two guide rods 51.

The picker 16, the holder 17 and the loader 18 are all well-known and will be described below only briefly. The picker 16 comprises a lift member 82 having a plurality of upward vacuum cups 81, and a guide piece 83 arched in cross section and extending below one of the side frame members 33, 34 in parallel therewith. When the vacuum cups 81 descend while attracting thereto by suction the lowermost of the blanks B stacked in the magazine 14, one edge of the blank B is guided by the guide piece 83, with the opposite ends of the blank B engaged by the unfolding pawls 39, 40, whereby the flat blank B is unfolded into a square or rectangular tube. The guide piece 83 has an inwardly bulging curved inner surface which is formed with a downward stepped portion 84 close to its lower end. The holder 17 comprises a guide rail 85 L-shaped in cross section and extending in parallel with the guide piece 83. The guide rail 85 and the stepped portion 84 coact to hold the tubular blank B delivered from the opening 31 at two diagonally opposed corners of the blank. The loader 18 comprises a pusher 86 movable in parallel with the guide piece 83 and the guide rail 85, whereby the blank B held by the holder 17 is pushed onto the mandrel 11.

Blanks B are loaded into and unloaded from the magazine 14 in the following manner.

When the kind of blanks B to be used is changed, the distance between the unfolding pawls 39, 40 needs to be adjusted in the manner already described.

Afther the unfolding pawls 39, 40 have been adjusted, the blank support members 76 on the elevator 15 are positioned in the vicinity of the upper end of the path of feed travel of the chains 75, and a stack of blanks B is placed on the members 76. When the drive sprockets 73 are driven in a direction to lower the blank support members 76, the blanks B are lowered as placed on the members 76 within the magazine 14. By this time, the movable blank supports 63, 64 are brought to their upper position. Upon the blank support members 76 descending past the movable blank supports 63, 64, the blanks B are transferred from the members 76 onto the blank supports 63, 64. Subsequently, the movable blank supports 63, 64 are moved from their upper position to the lower position. In the course of this movement, the blanks B are transferred from the supports 63, 64 onto the fixed blank supports 37, 38. In this state, the blanks are fed to the mandrels 11 in the usual manner.

It is assumed that blanks B remain within the magazine 14 on completion of the blank feeding operation. To unload the remaining blanks B from the magazine 14, the movable blank supports 63, 64 are first moved from the lower position to the upper position, whereby the remaining blanks B on the fixed blank supports 37, 38 are transferred onto the movable blank supports 63, 64 and lifted to above the frame 32. The movable guide rods 52 are then moved downward to the fallen position, whereupon the remaining blanks B slide down the guide rods 52 and are placed into the tray 55.

What is claimed is:

1. A blank feeder for a packaging machine for use with a plurality of kinds of folded flat blanks unfoldable into tubes of square to rectangular cross section and having different lengths to form containers of the same cross sectional area but varying heights so as to have different capacities, the blank feeder comprising:

a magazine for containing a multiplicity of flat blanks in a stack, the magazine having at its lower end a frame defining a downward delivery opening, the frame comprising a pair of side frame members arranged in parallel with each other and each inclined downward from its one end toward the other end thereof, a lower frame member :nterconnecting the lower ends of the side frame members and an upper frame member extending between the side frame members in parallel with the lower frame member at a position close to the upper ends of the side frame members and movable longitudinally of the side frame members, the side frame members being spaced apart from each other by a distance slightly larger than the distance between the opposite side edges of the blank, the side frame members being respectively provided on their bottom surfaces with a pair of fixed blank supports partly projecting into the delivery opening and spaced apart from each other by a distance slightly smaller than the distance between the opposite side edges of the blank, the lower and upper frame members being respectively provided on their bottom surfaces with a pair of blank unfolding pawls partly projecting into the delivery opening, the frame having means for moving the upper frame member for the blanks of different lengths to be accommodated in the magazine so that the end-to-end distance of the blank unfolding pawls will be slightly smaller than the distance between the opposite ends of the blank, each of the side frame members having at least one fixed guide rod extending upright therefrom, the lower frame member having at least one movable guide rod extending upright therefrom, the movable guide rod being fixed at its base end to a first reversibly rotatable pivot extending in parallel with the lower frame member and being downwardly movable to a fallen position in which the forward end of the rod is at a lower level than the base end thereof, a pair of pivotal arms extending below the fixed blank supports from outside the delivery opening into the delivery opening, each of the pivotal arms being provided at its forward end with a movable blank support the pivotal arms being respectively fixed at their base ends to second reversibly rotatable pivots extending in parallel with the side frame members, the movable blank supports being reciprocatingly movable between an upper position above the frame and a lower position below the frame through the delivery opening and being positionable, when in the upper position, at a higher level than the base end of the movable guide rod in the fallen position, the magazine having an elevator for moving the blanks upward and downward within the magazine and delivering at the lower limit of its downward movement the blanks to the movable blank supports in the upper position.

2. A blank feeder as defined in claim 1 wherein each of the fixed blank supports is a strip extending substantially over the entire length of the side frame member, and the upper frame member is placed at its opposite ends on the fixed blank supports, the moving means being a hydraulic cylinder comprising a cylinder tube and a piston rod, the cylinder externally having a slide guide face, the head of the cylinder tube being fixed to the outer side of the upper frame member with the slide guide face in contact with the inside surface of one of the side frame members, the piston rod being secured at its forward end to a fixed portion of the frame.

3. A blank feeder as defined in claim 1 wherein each of the pivotal arms is in the form of a bent strip in its entirety and comprises a straight portion and an arcuate portion, the straight portion extending radially of the corresponding second reversibly rotatable pivot and having a length equal to the distance between the second pivot and the movable blank support thereon, the arcuate portion connecting the forward end of the straight portion to the movable blank support and coinciding with approximately a quarter of a circumference centered next the second pivot and having a radius equal to the pivot-to-support distance, the movable blank support being in the form of a round bar extending in parallel with the second pivot.

4. A blank feeder as defined in claim 1 wherein the elevator comprises an upper sprocket and a lower sprocket respectively provided approximately at the same levels as the forward end and the base end of the fixed guide rod at each side of the magazine, an endless chain reeved around the upper and lower sprockets,and a blank support member fixed to the endless chain and projecting outward therefrom, the forward end of the blank support member being movable into the magazine when the blank support member is almost brought into the path of feed travel of the chain.

5. A blank feeder as defined in any one of claims 1 to 4 wherein the magazine is provided at a station where radial mandrels of an intermittently driven rotor stop as inclined obliquely downward, and the side frame members are arranged above and in parallel with an extension of the axis of the mandrel at rest at the station, the magazine being provided with a picker for delivering the flat blank from the magazine while unfolding the blank into a tubular form of square to rectangular cross section, a holder for retaining the delivered tubular blank in shape and a loader for removing the tubular blank from the holder and fitting the blank onto the mandrel at rest at the station.

* * * * *